US006851962B2

(12) United States Patent
McCormack, III

(10) Patent No.: US 6,851,962 B2
(45) Date of Patent: Feb. 8, 2005

(54) HERMETIC CONNECTOR

(75) Inventor: George John McCormack, III, Long Beach, CA (US)

(73) Assignee: Hermetic Seal Corp., Rosemead, CA (US)

( * ) Notice: Subject to any disclaimer, the term of this patent is extended or adjusted under 35 U.S.C. 154(b) by 0 days.

(21) Appl. No.: 10/403,189

(22) Filed: Mar. 31, 2003

(65) Prior Publication Data

US 2003/0236030 A1 Dec. 25, 2003

Related U.S. Application Data

(60) Provisional application No. 60/369,179, filed on Apr. 1, 2002.

(51) Int. Cl.[7] ..... H01R 13/52
(52) U.S. Cl. ..... 439/276; 439/874
(58) Field of Search ..... 439/276, 282, 439/278, 911, 935, 271, 932–933, 874, 520, 693; 174/152

(56) References Cited

U.S. PATENT DOCUMENTS 4,252,394 A * 2/1981 Miller ..... 439/566
4,296,275 A * 10/1981 Bowsky ..... 174/152 GM
5,271,975 A * 12/1993 Solano ..... 428/34.9
5,493,073 A * 2/1996 Honkomp ..... 174/152 GM
5,584,716 A * 12/1996 Bergman ..... 439/282
6,509,525 B2 * 1/2003 Honkomp et al. ..... 174/50.52

* cited by examiner

*Primary Examiner*—Gary Paumen
*Assistant Examiner*—Edwin A. Leon
(74) *Attorney, Agent, or Firm*—Henry I. Schanzer

(57) ABSTRACT

Connectors embodying the invention include a metallic shell having an inner wall for securely holding a glass preform within the inner wall of the metallic shell. The preform has generally parallel top and bottom surfaces with a number of predetermined contact pin holes extending between the top and bottom surfaces. Hollow tubular sleeves for securing and supporting contact pins are positioned within selected ones of the contact pin holes; each tubular sleeve having a bottom end embedded in the preform and a top end extending above the top surface of the preform. Contact pins of conductive material are securely positioned within the tubular sleeves; each contact pin having a top end extending above the top end of its associated tubular sleeve and a bottom end extending below the bottom surface of the preform. Conductive wires may be connected to the top ends of the contact pins, with each tubular sleeve providing support for its associated contact pin and the corresponding wire connection. Then, insulating shrink tubing, extending from the top surface of the preform, may be placed over each tubular sleeve, its corresponding contact pin and a portion of the associated wire including the wire connection to the contact pin. The wire and its interconnection to a contact pin may be examined before and after the application of the shrink tubing.

16 Claims, 10 Drawing Sheets

FIG.2B1

HERMETIC CONNECTOR

This Application is a Utility Application claiming the benefit of the earlier filing date of Provisional Application, Ser. No. 60/369,179 filed Apr. 1, 2002 and titled Improved Hermetic Connector whose entire subject matter is incorporated herein by reference.

BACKGROUND OF THE INVENTION

This invention relates to an improved connector and, in particular, to an improved hermetically sealed connector.

Known prior art connectors include a connector with the connector pins soldered to wires. As shown in prior art FIGS. 10 and 10A, a potting boot or cup 403 is placed around the connector pin ends. An epoxy 401 is poured into the boot to hold the connector pins and their associated wires in place and to further isolate them from each other. There are several problems with the prior art scheme. One of the problems is the use of the epoxy which requires that the epoxy components be kept under refrigeration and mixed shortly before usage. Another problem with epoxy is that the epoxy must be applied very shortly after being mixed. Still another problem is that the epoxy must be cured for some time at a curing temperature. Furthermore, once the epoxy has been poured into the boot it is no longer possible to make a visual inspection. Epoxy is subject to voids and may be brittle or soft whereby, when such connectors are place in an environment containing a liquid, as shown in FIG. 10, the liquid may penetrate through the epoxy to the connector pins giving rise to numerous problems. These problems are overcome in connectors formed in accordance with the invention.

SUMMARY OF THE INVENTION

Connectors embodying the invention do not need epoxy or a boot to provide structural strength to the connector and wires.

Connectors embodying the invention include a metallic shell having an inner wall for securely holding a preform within the inner wall of the metallic shell; where the preform is made of an insulating material such as glass. The preform has generally parallel top and bottom surfaces and may include a number of predetermined contact pin holes running form the top surface to the bottom surface. Hollow tubular sleeves of non-conductive material, having a top end and a bottom end, are positioned within selected ones of the contact pin holes. The bottom end of each tubular sleeve is embedded in the preform while the top end of each tubular sleeve extends above the top surface of the preform for a given distance. Contact pins of conductive material are securely positioned within the tubular sleeves; each contact pin having a top end and a bottom end. The top end of each contact pin includes a cup adapted to receive a wire connection and extends above the top end of its associated tubular sleeve a given distance above the top surface of the preform. The bottom end of each contact pin extends below the bottom surface of the preform for a predetermined distance.

Connectors embodying the invention include shrink tubing extending from the top surface of the preform over the tubular sleeve, the contact pin and a portion of the wire including the wire connection to the contact pin. The shrink tubing functions to provide electric insulation between adjacent contact pins and also provides structural support to the contact pin and wire assembly.

A significant advantage of connectors embodying the invention is that the tubular sleeve provides support for the contact pin and the corresponding wire connection. The wire and its interconnection to a contact pin may be examined before and after the shrink tubing is positioned over the wire/contact pin connection and the combination remains visible, even after the shrink tubing is applied. This eliminates the prior art problem of determining the status of the connection after it is covered with epoxy.

In one embodiment the tubular sleeve is made of a ceramic material and its bottom portion may be "L" shaped for anchoring the tubular sleeve within the preform.

In connectors embodying the invention the metallic shell may include a flange for attaching the connector to the walls of a tank containing different types of fuels or liquids; with the top portion of the preform being located on the inside of the tank.

A connector embodying the invention may be formed by securing an insulated preform with preformed contact pin holes within a machined shell; the insulated preform having a top and bottom surfaces, generally parallel to each other. Hollow tubular sleeves of insulated material are inserted in the contact pin holes with their bottom end embedded within the insulated preform and their top end extending above the top surface of the preform. Contact pins of conductive material having a top end and a bottom end are inserted through selected ones of the tubular sleeves with the top end of the contact pins extending a first distance above the tubular sleeve and the top surface of the preform and the bottom end of the contact pins extending a second distance below the bottom surface of the preform. The temperature coefficients of the metal shell and of the insulated preform are selected to ensure that when the combination is subjected to heat and then cooled the preform will be securely held by the metal shell. The temperature coefficients of the insulated preform, the tubular sleeves and the contact pins are also selected to enable the tubular sleeves to be embedded within the preform and the contact pins to be positioned relative to the preform and the sleeves and to be securely held within the sleeves when the combination is subjected to heat and then cooled.

BRIEF DESCRIPTION OF THE DRAWINGS

In the accompanying drawings like reference characters denote like components.

FIGS. 2A and 2B and 2B1 are more detailed views of parts of a connector embodying the invention with wire connections to contact pins in accordance with the invention;

DETAILED DESCRIPTION OF THE INVENTION

Figure 1:
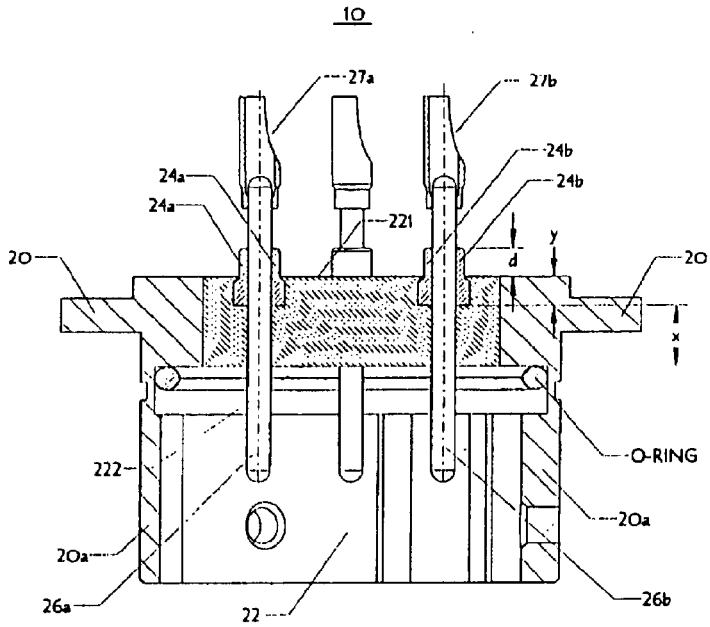
FIG. 1 is a cross-sectional diagram (not to scale) of a basic connectior structure embodying the invention.

The invention may be illustrated with reference to FIGS. 1 and 2, which are idealized, not to scale, cross-sectional representations of a connector formed in accordance with the invention. FIG. 1 shows a connector 10 which includes a metallic shell 20 and a glass preform 22 firmly secured to and within the internal walls 20*a* of the shell 20. Embedded in glass preform 22 are generally "L" shaped tubular sleeves 24*a*, 24*b*. The horizontal portions of the "L" ensure that the tubular sleeves are well anchored, and remain anchored, in the glass preform 22. The tubular sleeves may be made of "macor" or any other suitable material. The macor tubular sleeves 24 are made of a ceramic material which is machinable and which has a temperature coefficient which is similar to, and compatible with, that of glass. Note that the tubular sleeves extend (vertically in the drawing) a distance "d" above the top surface 221 of glass preform to provide support for contact pins (26*a*, 26*b*) and to enable the anchoring of shrink tubing, as discussed below. [Note that surface 221 of glass preform 22 is arbitrarily defined as the "top" surface and that surface 222 of glass preform 22 is arbitrarily defined as the "bottom" surface.]

Contact pins 26*a*, 26*b* are located within the tubular sleeves (24*a*, 24*b*). The "top" part of each contact pin extends above the top surface 221 of the glass preform 22 and above the top of its associated tubular sleeve (24*a*, 24*b*) and the "bottom" end portion of each contact pin extends below the bottom surface 222 of the glass preform 22 and is extended to make contact to, and with, a receptacle in a mating connector part. It should be appreciated that the tubular sleeves 24*a*, 24*b* function to relieve and redistribute any bending stress to which the "upper portion" of contact pins 26*a*, 26*b* are subjected.

Figure 2:
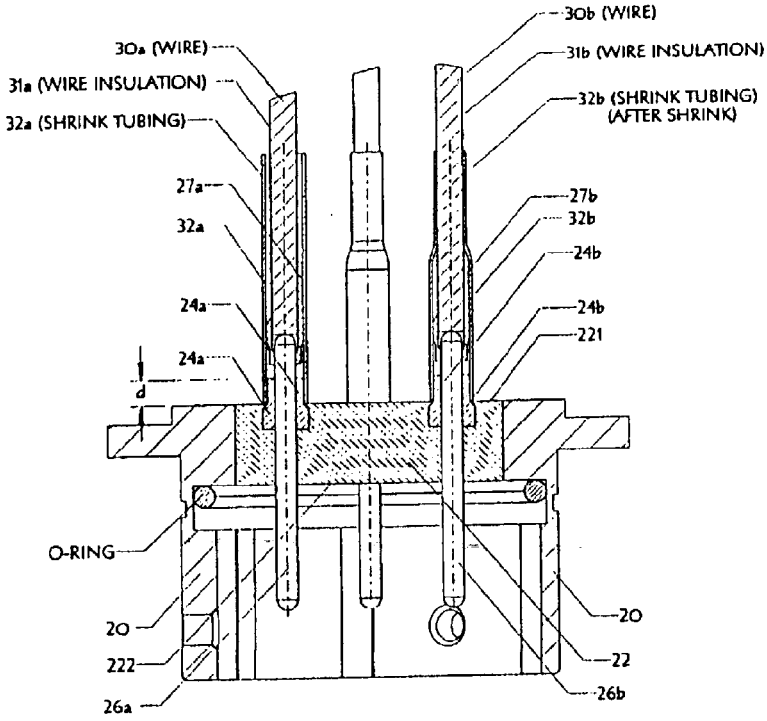
FIG. 2 is a cross-sectional diagram of a connector embodying the invention with wires connected to the connector in accordance with the invention.
Figure 2A:
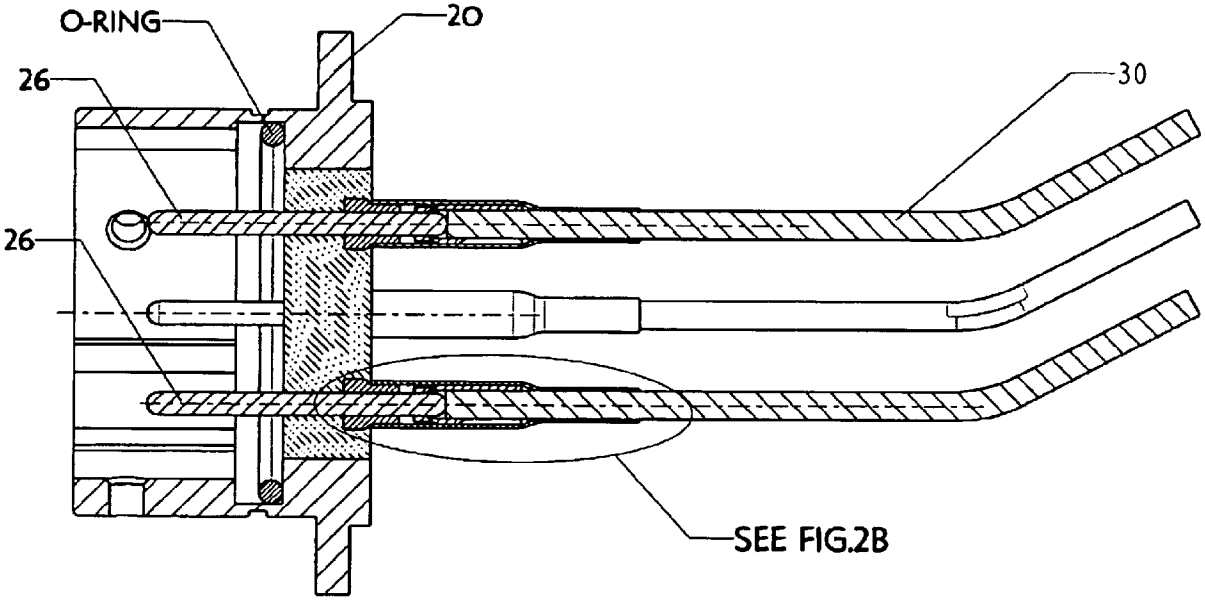
Figure 2B:
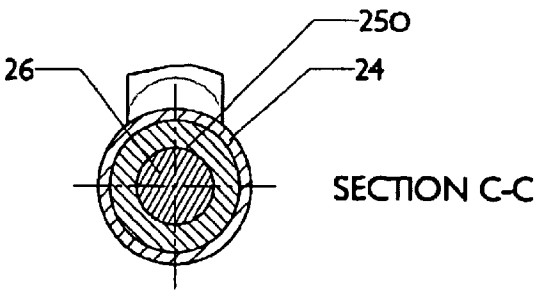
Figure 2B:
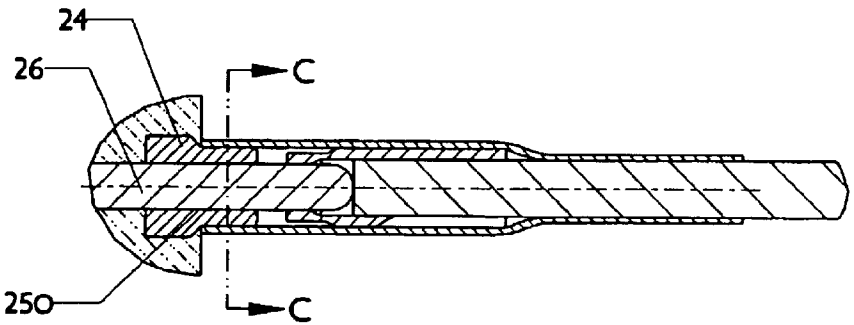

FIG. 2 illustrates the connection of wires 30*a*, 30*b* to the contact pins 26*a*, 26*b* of connector 10. (See also FIGS. 2A and 2B which are more to scale than FIG. 2). FIGS. 2B and 2B1 are intended to show that there may be a gap 250 between a contact pin 26 and the internal wall of the tubular sleeve 24. The tubular sleeve which in one embodiment of the invention is a macor ceramic is also referred to as a "riser". The gap or space, 250, between the contact pin and the riser 24 is designed to increase the creep path for electric current since the increased creep path effectively increases the insulation resistance. The gap 250 is just large enough to enable plating solution(s) applied to contact pins to be applied and easily washed away. In addition, the gap provides enough space between a contact pin and the inner walls of its macor riser 24 so that if, and when, the contact pin 26 is subjected to vibration stresses there is no rupture of the riser and or the pin. The bottom portion of the macor riser 24 is recessed and embedded in the glass preform 22. Also, the portion of the pin 26 below the bottom of the tubular sleeve (riser) 24 is fully constrained by the glass preform 22 to provide hermetic sealing.

Figure 3A:
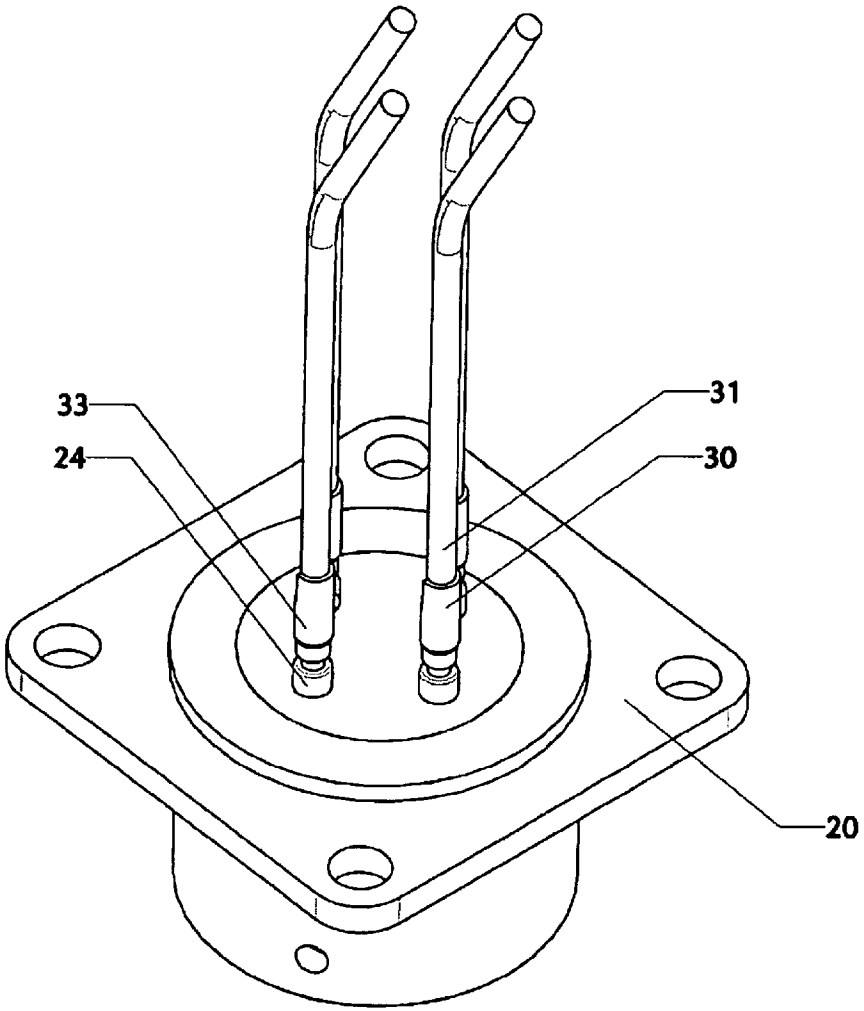
FIG. 3A is a photograph showing two wires connected to a connector embodying the invention.

Note that wires 30*a*, 30*b* are connected (soldered) to solder receptor cups 27*a*, 27*b* formed at the "upper" ends of contacts 26*a*, 26*b*. (See also FIG. 3A which is a photograph of one embodiment in which wires are soldered to solder cups). FIG. 2 also illustrates that shrink tubing (32*a*, 32*b*) is placed over the wires 30*a*, 30*b*, with each wires having a conductive core (30) surrounded by a wire insulation (31). The shrink tubing extends over the tubular sleeves down to the "top" surface 221 of the glass preform 22. FIG. 2 illustrates the placement of the shrink tubing 32*a* over the wire 30*a* soldered to contact 26*a* and over the tubular sleeve 24*a*. Note that the tubular sleeve (24*a*, 24*b*) also functions as a guide to ensure that the shrink tubing surrounds the contact pin and the portion of the tubular sleeve which extends above surface 221 of preform 22. That the shrink tubing is correctly placed over the tubular sleeve may be ascertained by visual inspection or by any other suitable means. FIG. 2 also illustrates the appearance of the shrink tubing 32*b* after "shrink" (i.e., after heat has been applied to the shrink tubing 32*b* and the tubing has "shrunk" around the tubular sleeve 24*b*, the contact pin 26*b* and the wire insulation 31*b*). (See also FIG. 3B which is a photograph of the connector with shrink tubing "shrunk" over the wires.) The shrink tubing provides isolation for each wires and each contact pin individually and separately and provides an element of support at the base near the connector "top" surface. The tubular sleeves 24*a*, 24*b*, ensure that the shrink tubing 32*a*, 32*b* is correctly placed and that even if there is some pull back of the tubing, the vertical portion of the tubular sleeve ensures that a good seal is maintained. Thus, after the shrinking of the shrink tubing the contact pins are electrically insulated and physically isolated from each other and the connections are also water tight. It is also evident that the connections may be visually checked. Therefore, this construction is better than using epoxy to hold the contact pins in place, since the epoxy does not allow for visual inspection and does not block liquid from accessing the contact pins.

Figure 3B:
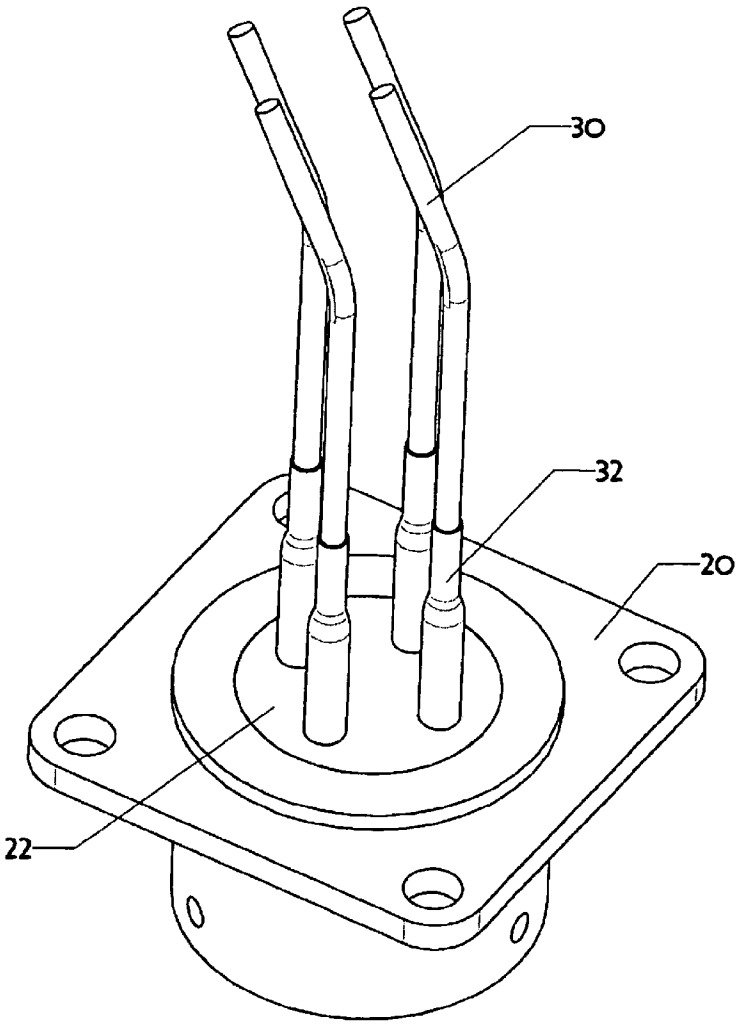
FIG. 3B is a photograph showing 4-wires connected to a connector embodying the invention with shrink tubing covering the wires and the tubular sleeves in accordance with the invention.
Figure 10:
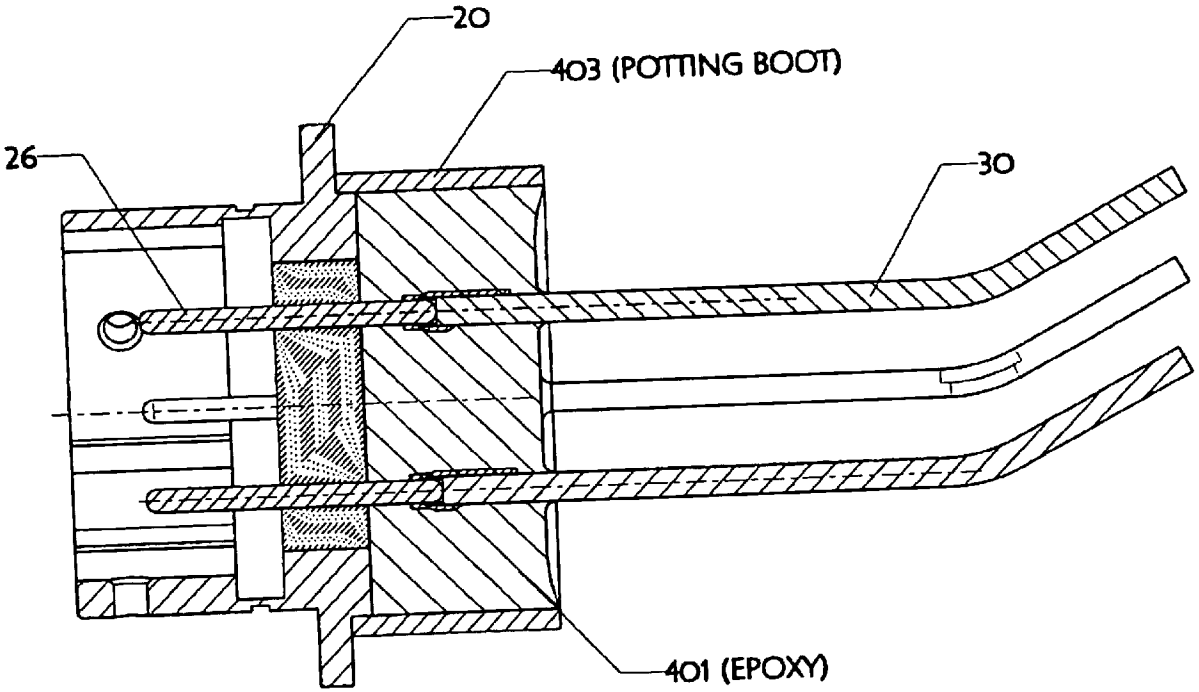
FIG.10 PRIOR ART
FIG. 10 is a cross-sectional diagram of a prior art connector.
Figure 10A:
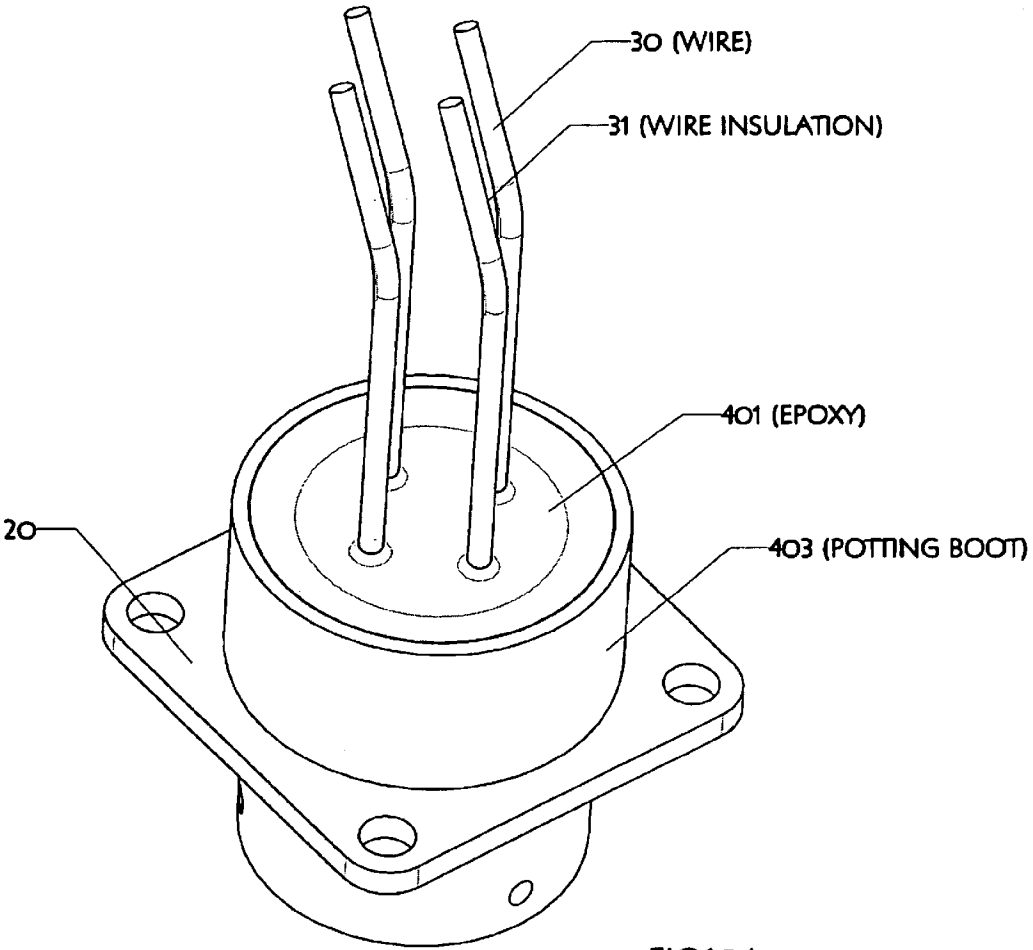
FIG.10A PRIOR ART
FIG. 10A is a photograph of a prior art connector.

This may be illustrated by comparing FIG. 3B to prior art FIGS. 10 and 10A which show a potting boot 403 formed over and covering the wire terminals. It is evident from a comparison of the figures that the shrink tubing 32 overlying the tubular sleeves 24 block a potential liquid (fuel) leak path (See FIG. 4) from contacting the wires 30. The shrink tubing causes any potential leak path between any liquid and the conductive portion of any wire to be increased, since any fuel (or liquid) must flow into and along the shrink tubing before coming into contact with the contact pin 26. This potential leak path is significantly inhibited by the use of shrink tubing which wraps tightly around the macor tubular sleeves 24*a*, 24*b* and the contact pins 26 and the wire insulation 31 and the wire 30 connected to the contact pin. This is in contrast to the prior art use of epoxy which may allow liquid to seep through the epoxy 401 and contact the wire.

In the manufacture of the connector the glass preform 22 is constricted: (a) about the contact pins 26*a*, 26*b* for the length "x" below the macor sleeve 24 to ensure a high degree of hermeticity (see FIG. 1); and (b) about the tubular sleeves 24*a*, 24*b* for a length "y" to ensure that the sleeves are anchored and embedded in the glass preform. The tubular sleeves 24, in turn, surround their associated contact pins 26 giving them support and providing guidance for the subsequent insertion of tubing around the contact pins and the sleeves down to the top surface of the glass preform.

Figure 4:
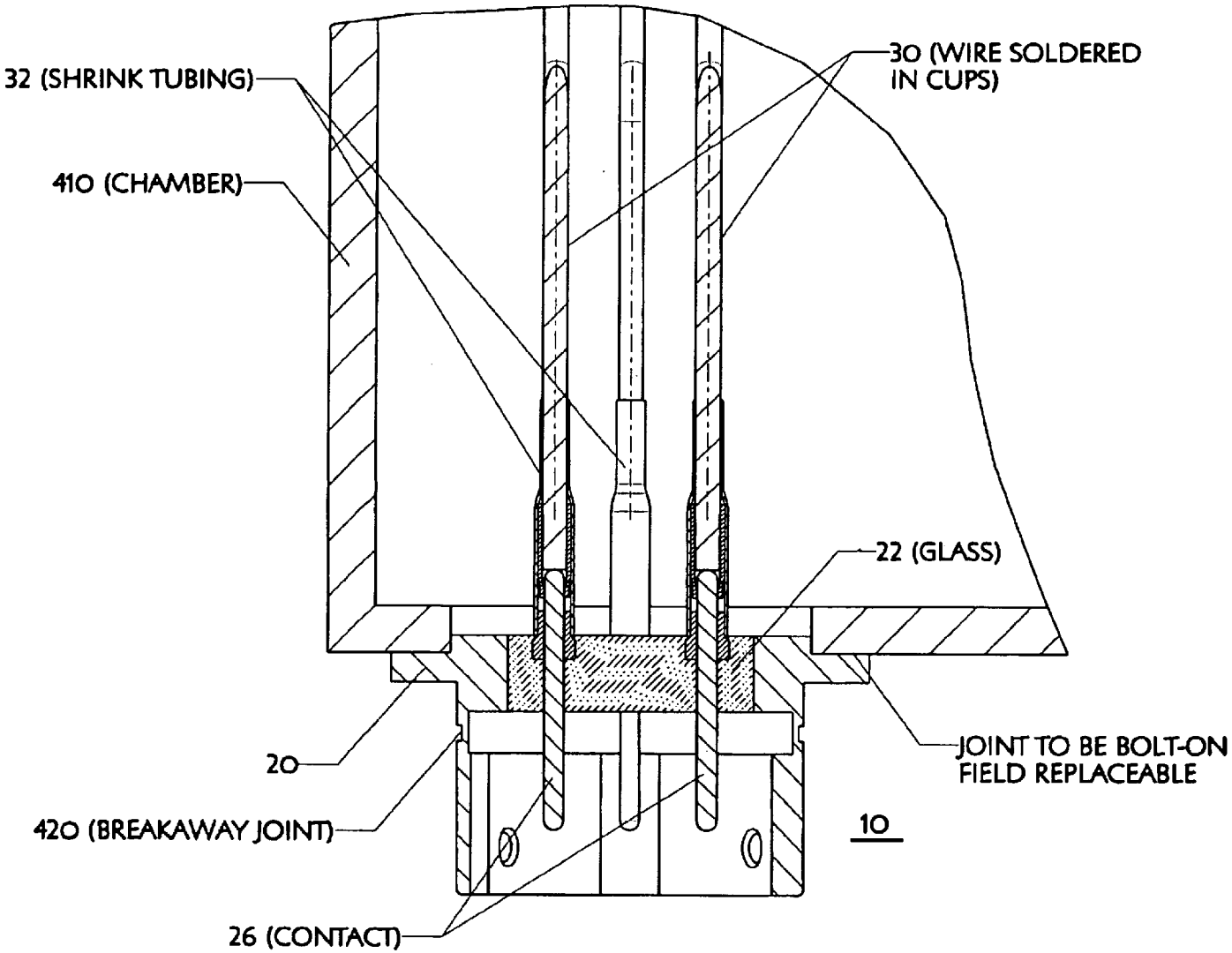
FIG. 4 is a cross-sectional diagram of a connector embodying the invention connected to a fuel tank.

FIGS. 4 shows a cross sectional view of the connector 10 with the top portion of the flange of the shell 20 bolted on (or welded) to the outer surface of a fuel chamber/tank 410.

The fuel chamber may include a liquid and the portion of the connector within the chamber is designed such that the shrink tubing shields the wire and wire connection so as to isolate and insulate the contacting pins from the fuel or liquid within the chamber.

The connector 10 includes a breakaway joint 420 shown in FIG. 4. When the connector is subjected to great stress, the "lower" portion of connector 10 is designed to break off at the joint 420. The hermetically sealed "upper" portion of the connector remains bolted in and secured. As a result, the portion of the connector bolted to the chamber remains intact and any fluid within the chamber remains contained within the chamber.

Figure 5:
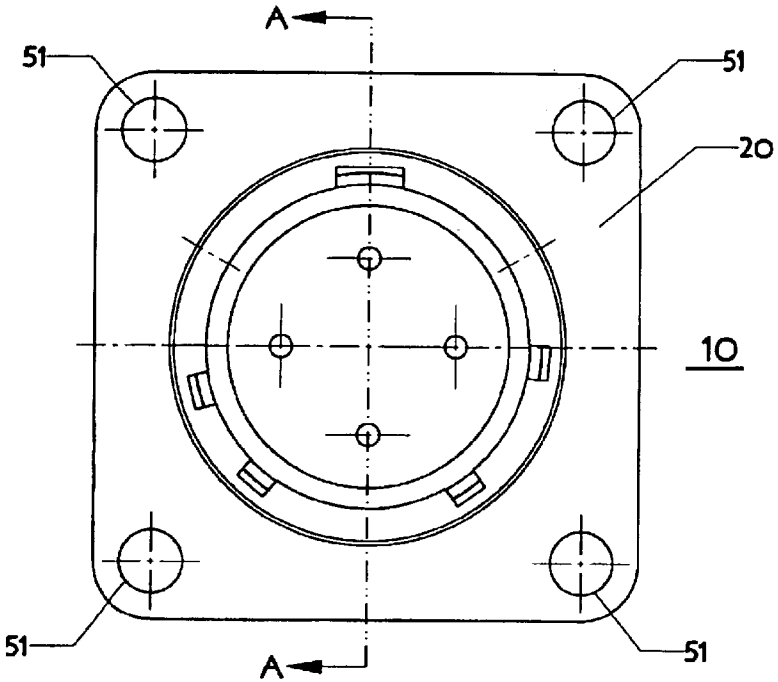
FIG. 5 is a bottom view of a flange extending form the shell of a connector embodying the invention.

FIG. 5 is and end view of a connector embodying the invention. As indicated from FIG. 5, the connector shell 20 may include a flange with holes 51 to enable the shell to be bolted to the wall of a chamber or any other suitable surface.

Figure 6:
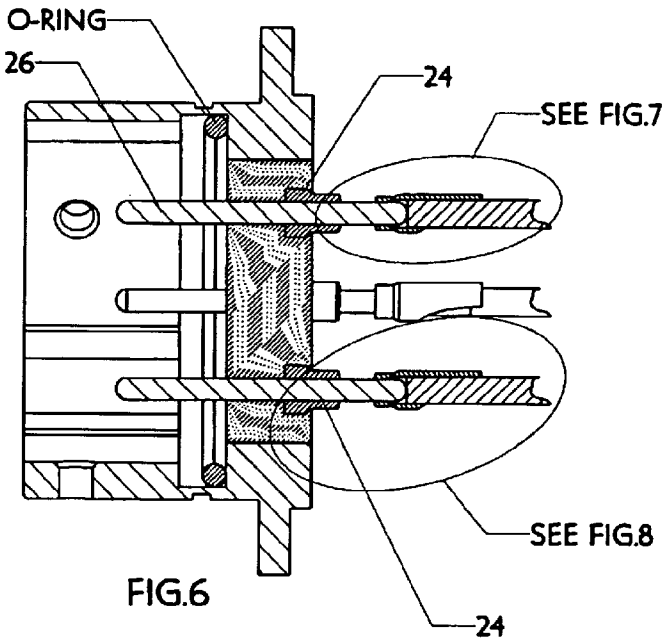
FIG. 6 is a cross-sectional diagram of the connector of FIG. 5.
Figure 8:
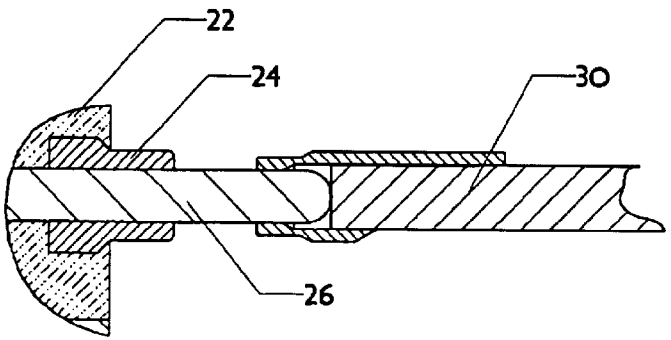
FIG. 8 is a detailed cross-section of a tubular sleeve and a contact pin with a cup to receive a wire in accordance with the invention.
Figure 7:
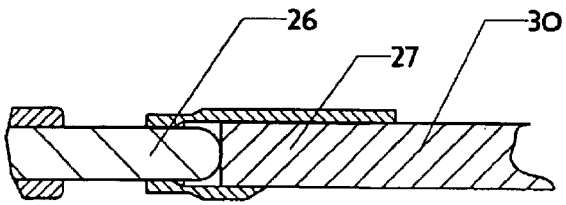
FIG. 7 is a detailed cross-section of the top of a contact pin including a cup to receive a wire.

FIG. 6 (like FIG. 1, but more to scale) is a cross-section of the connector of FIG. 5 taken along line A—A. FIG. 7 shows a detail of the top portion of the contact pins 26 shown in FIG. 6 extending to receive a wire 30 within a cupping arrangement 27 formed at the top of the contact pin 26. FIG. 8 is a cross-sectional detail of the tubular sleeve 24 of FIG. 6 anchored in preform 22 and extending to hold the contact pin.

Figure 7A:
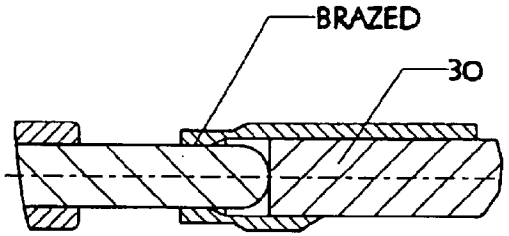
FIGS. 6A, 7A and 8A are similar to FIGS. 6, 7 and 8, respectively, but show solder cups brazed to the top of the contact pins.
Figure 8A:
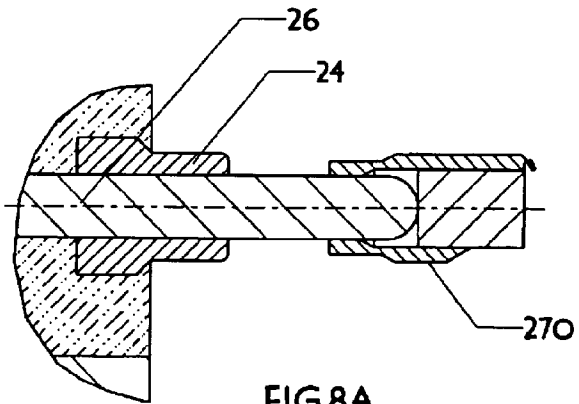
Figure 6A:
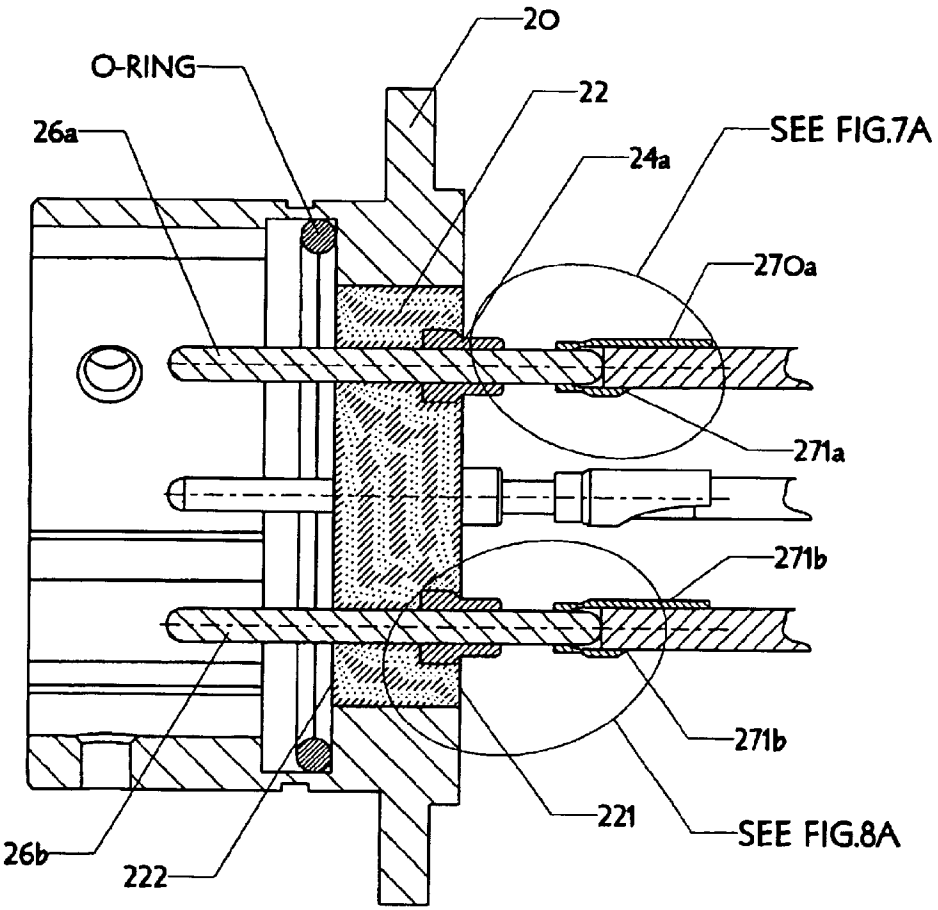

FIGS. 6A, 7A and 8A show another scheme for securing contact between the wires 30 and the contact pins 26. In these figures, a solder cup 270 is brazed or otherwise secured to the top of the contact pin 26. The solder cup 270 is shaped to receive a wire 30 which is then soldered to the solder cup. FIG. 7A is a detail of the solder cup at the top of contact pins shown in FIG. 6A. FIG. 8A is a cross-sectional detail of the tubular sleeve 24 of FIG. 6A with the solder cup attached.

The figures illustrate that the contact pins 26 are secured and sealed within the connector. The shell frame 20 holds the preformed glass layer 22 through which the pins 26 are passed at predetermined points and which are secured to the glass layer 22 when the shell and glass layer are raised to a temperature causing the glass layer to soften and when the assembly is then cooled, resulting in compression and sealing. To further hold the contact pins in place and to provide support for the pins the macor tubular sleeves 24 are anchored within the glass layer by the step of raising the temperature of the connector assembly and then cooling the assembly. The portion of the macor sleeve 25 facing away from the pins is L shaped, whereby the horizontal portion of the L acts as an anchor.

Making the Connector

The portion of the connector 10 shown in the figures may be formed by assembling a machined shell 20, a glass preform 22, machined contact pins 26 and machined macor tubular sleeves 24. A graphite fixture (not shown) may be used to hold the machined shell 20 of the type shown in the figures. The shell 20 may be of cold rolled or stainless steel or any like material. The glass preform 22 (or any suitable dielectric) with preformed contact pin holes is inserted within the shell 20. Machined contact pins, 26, may be pushed through the contact pin holes previously drilled or formed in the glass preform. The contact pins extend a predetermined distance above the top surface 221 of the glass preform 22 and a predetermined distance below the bottom surface 222 of the glass preform. The macor tubular sleeves (24*a*, 24*b*) whose outer bottom region flares out, giving the macor sleeves an "L" shape, may then be slipped over the contact pins (26*a*, 26*b*). Alternatively the macor sleeves may be positioned on the glass preform in line with the contact pin holes and the contact pins may be inserted through the macor sleeves and the glass preform. The graphite fixture is configured to enable weights to be applied to the top of the macor sleeves to cause them to "sink" and become embedded in the glass preform 22 when the graphite fixture, with the assembled connector, is inserted in a furnace, as discussed below.

The assembled connector components are placed in a furnace which raises the temperature to the point (e.g., approximately 1800 degrees farenheit) that the glass preform becomes soft. The macor sleeves "sink" into the glass preform due to their own weight and/or due to the additional weight placed on the macor sleeves. The contact pins 26 are held in place by the graphite fixture (i.e., jig). After this process step, the connector assembly is cooled by lowering the temperature of the furnace to room temperature.

Note that the macor and glass preform have similar temperature coefficients (e.g., 87 in/in/° C.), whereby they expand and contract at a very similar rate. However, the shell 20 is selected to have a much larger temperature coefficient (e.g., 150 in/in/° C.) than the glass preform. Consequently, when the temperature of the furnace is lowered, the shell contracts faster, and more, than the glass preform. The contracting action of the shell causes the glass preform to be firmly enclosed by the shell and to be constricted. The constrictive action causes: (a) a seal between the outer periphery of the glass preform and the inner surface of the shell; and (b) a seal between the glass preform and the portion of the contact pins extending within the glass preform below the macor sleeves. The constrictive pressures applied to the glass preform also ensure that the macor sleeves become firmly embedded in the glass preform and around the contact pins. The connector is thus formed with hermetic sealing between the top and bottom surfaces of the connector. The connector contact pins (and the shell) may then be cleaned and plated to facilitate the subsequent soldering of the contact pins (and the shell).

The connector so formed may be used in many different applications. By way of example, wires may be soldered to the contact pins 26 in the solder cups 27. Then, shrink tubing is installed over the contact pins and over the tubular sleeves 24. The macor tubes 24 embedded in the glass preform and extending a distance "d" above the top surface of the glass preform function to support the contact pins and as a holding sleeve preventing bending and twisting forces to be developed between the contact pins and the top surface of the glass preform when wires are attached to the contact pins. Moreover the tubes 24 function as guides for the shrink tubing to be placed over the contact pins and to enable the tubing to extend down to the top surface of the glass preform. The shrink tubing is then "shrunk" by the application of heat to the tubing. Each contact pin of a connector is then insulated physically and electrically from any other contact pin and the condition is readily checked visually. The wires may extend to any appropriate point and the shell of the connector may be attached to a selected surface. A mating connector may then be attached to the "bottom" side of the connector to contact the contact pins.

Figure 9:
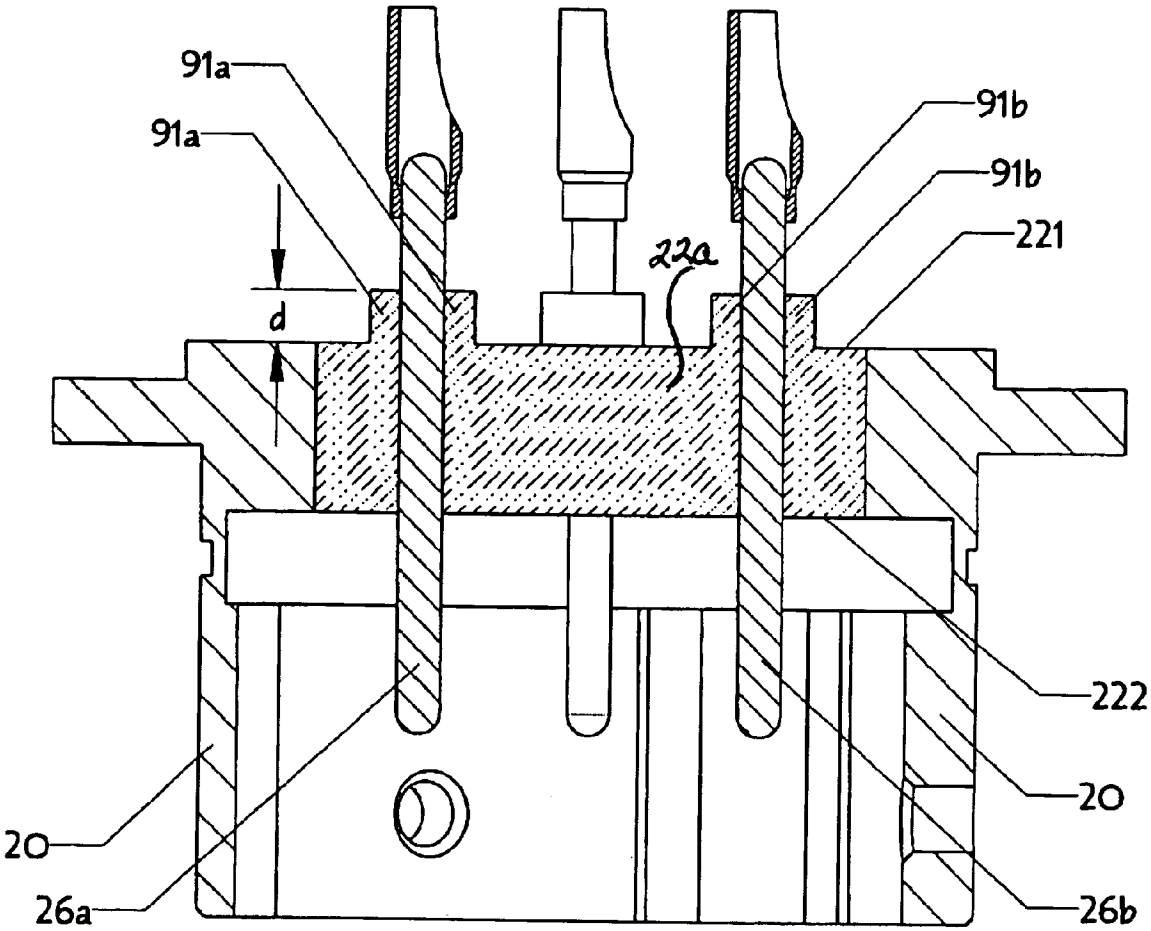
FIG. 9 is another cross-sectional diagram of a connector embodying the invention.

Another embodiment of the invention is shown in FIG. 9. In this embodiment the glass preform 22*a* includes tubes 91*a*, 91*b*, extending a height "d" above the "top" surface 221 of the glass preform 22*a*. The tubes or mesas 91*a*, 91*b* may be an integral part of the glass preform, resulting in a somewhat simpler construction than when the macor tubes are used.

Features of a connector embodying the invention may include a stainless steel connector body which is corrosion resistance; high current contact pins with a copper core to enable the connector to carry more current through the contacts, increased flange thickness and increased glass thickness to make the connector explosion proof, "break away" shell design which enables the shell to separate leaving the glass seal integrity in place. Also, as already noted, the shrink tubing provides greater temperature, life and fluid resistance than epoxy. The design also increases the impedance of the electrical and fluid creep paths from contact to contact. Furthermore, there has been an increase in these paths from the contacts to the body with the height of the macor sleeves (riser). In addition, visual inspection of the assembly and the contacts is possible which also makes repair of a bad joint possible. The assembly is simpler than the prior art arrangement enabling a reduction in assembly, time and material costs while providing an increased reliability.

What is claimed is:

1. A connector comprising:

a metallic shell having an inner wall;

a preform, made of non-conductive material, firmly secured within the inner wall of the metallic shell, said preform having generally parallel top and bottom surfaces and a number of contact pin holes extending between the top and bottom surfaces;

a hollow tubular sleeve per contact pin hole, each tubular sleeve having a top end and a bottom end, the bottom end of the tubular sleeve being embedded in the preform and the top end of the tubular sleeve extending above the top surface of the preform for a predetermined distance;

a contact pin of conductive material secured within each tubular sleeve, each contact pin extending through the tubular sleeve and the preform, said contact pin having a first, top, end extending above the top end of the tubular sleeve by a first distance and having a second, bottom, end extending below the bottom surface of the preform by a second distance; each tubular sleeve extending above the top surface of the preform for said predetermined distance for holding its associated contact pin and for providing support to its associated contact pin for the portion of the contact pin extending through the tubular sleeve and above the tubular sleeve; and the first end of each contact pin including means for connecting a wire thereto.

2. The connector as claimed in claim 1 wherein said wire includes a conductive core wire portion surrounded by an insulator cover and wherein said conductive core wire portion is bonded to the first end of the contact pin and further including means for placing shrink tubing over each contact pin its associated wire and its associated tubular sleeve, with the tubular sleeve functioning as a guide so as to enable the shrink tubing to extend from the top surface of the preform over and along the top end of each tubular sleeve and the first end of its corresponding contact pin and then along its corresponding conductive core wire portion and its insulation for a predetermined distance.

3. The connector as claimed in claim 1 wherein the preform is made of a glass material.

4. The connector as claimed in claim 3 wherein the tubular sleeve is made of a ceramic material.

5. The connector as claimed in claim 4 wherein the metallic shell includes a flange for attaching the connector to the walls of a tank.

6. The connector as claimed in claim 4 wherein the bottom portion of the tubular sleeves is of a general "L" shape for anchoring the tubular sleeve within the preform.

7. The connector as claimed in claim 4 wherein the shrink tubing provides insulation between adjacent contact pins and support for its corresponding contact pin.

8. The connector as claimed in claim 4 wherein the material forming the tubular sleeve and the material forming the preform have similar temperature coefficients.

9. The connector as claimed in claim 8 wherein the material forming the metallic shell and the material forming the preform have different temperature coefficients whereby following a heating and cooling cycle the metallic shell holds the preform securely.

10. The connector as claimed in claim 1, wherein each tubular sleeve has a generally tubular inner surface and an external surface which flares outwardly at its bottom end, wherein the inner surface of a tubular sleeve is for constrictively holding and supporting its corresponding contact pin and its bottom end is embedded within the preform at a point between the top and bottom surfaces of the preform.

11. The connector as claimed in claim 10, wherein the outer diameter of the top end of the tubular sleeve is less than the outer diameter of the portion of the tubular sleeve embedded in the preform; and wherein the tubular sleeve functions as a guide for the placement of shrink tubing over the external surface of the tubular sleeve, its contact pin and any wire connected to the contact pin.

12. The connector as claimed in claim 10, wherein the preform holds the tubular sleeves constrictively and also holds constrictively the portion of the contact pins extending through the contact pin holes below the bottom of the tubular sleeves whereby the portion of the connector above the top surface of the preform is hermetically sealed from the portion of the connector below the bottom surface of the preform.

13. A method of making a connector comprising the steps of:

inserting a preform made of insulator material within a machined metallic shell, the preform having top and bottom surfaces, generally parallel to each other; and having preformed contact pin holes extending between the top and bottom surfaces;

inserting hollow tubular sleeves of non-conductive material within the contact pin holes and embedding the tubular sleeves within the insulated preform; the tubular sleeves having a top portion extending a predetermined distance above the top surface of the preform and having a bottom portion designed to be embedded within the preform; and placing contact pins of conductive material through the tubular sleeves, the contact pins having a top end and a bottom end; the top end of each contact pin extending a first distance above the top portion of its corresponding tubular sleeve whereby the portion of the tubular sleeve extending above the top surface of the preform provides support for the portion of the contact pin extending through the tubular sleeve and above the tubular sleeve, and the bottom end of each contact pin extending a second distance below the bottom surface of the preform.

14. The method as claimed in claim 13 further including the steps of applying heat to the connector assembly and then cooling the connector assembly to ensure that the metallic shell holds the preform, that the tubular sleeves are embedded in the preform and that the contact pins are securely held within the tubular sleeves and the preform and wherein the portion of the connector above the top surface of the preform is hermetically sealed relative to the portion of the connector below the bottom surface of the preform.

15. A connector assembly comprising:

a metallic shell having an inner wall;

a preform, made of non-conductive material, firmly secured within the inner wall of the metallic shell, said preform having generally parallel top and bottom surfaces and a number of contact pin holes extending between the top and bottom surfaces;

a hollow tubular sleeve per contact pin hole, each tubular sleeve having a top end and a bottom end, the bottom end of the tubular sleeve being embedded in the preform and the top end of the tubular sleeve extending above the top surface of the preform for a predetermined distance;

a contact pin of conductive material secured within each tubular sleeve, each contact pin extending through the tubular sleeve and the preform, said contact pin having a first, top, end extending above the top end of the tubular sleeve by a first distance and having a second, bottom, end extending below the bottom surface of the preform by a second distance; each tubular sleeve extending above the top surface of the preform for providing support to its associated contact pin for the portion of the contact pin extending through and above the top end of the tubular sleeve and the tubular sleeve for holding its associated contact pin;

means for connecting a conductive core wire portion surrounded by an insulator cover to the first end of each contact pin;

means for placing shrink tubing over each contact pin its associated wire and its associated tubular sleeve so the shrink tubing extends from the top surface of the preform over and along each tubular sleeve and the first end of its corresponding contact pin and then along its corresponding conductive core wire portion and its insulation for a predetermined distance; and means for attaching the connector to the walls of a tank so the top surface of the preform is internal to the tank and the bottom surface of the preform is external to the tank.

16. The connector assembly as claimed in claim 15 wherein the metallic shell constricts the preform and wherein the preform constricts the tubular sleeves and the contact pins whereby the portion of the preform above the top surface of the preform is hermetically sealed relative to the bottom portion of the preform.

* * * * *